United States Patent [19]

Mettenleiter et al.

[11] Patent Number: 4,663,800

[45] Date of Patent: May 12, 1987

[54] HOLDING DEVICE FOR DOOR CLOSERS

[75] Inventors: Karl Mettenleiter, Weil der Stadt; Ralf Storandt; Georg Scheck, both of Leonberg, Fed. Rep. of Germany

[73] Assignee: GEZE GmbH, Leonberg, Fed. Rep. of Germany

[21] Appl. No.: 769,710

[22] Filed: Aug. 27, 1985

[30] Foreign Application Priority Data

Sep. 14, 1984 [DE] Fed. Rep. of Germany ..... 3433891
Apr. 30, 1985 [EP] European Pat. Off. ..... 85105289.4

[51] Int. Cl.[4] ..... E05F 3/04

[52] U.S. Cl. ..... 16/51; 16/53; 16/72; 16/DIG. 9

[58] Field of Search ..... 16/48.5, 49, 51, 52, 16/53, 56–60, 64–66, 72, 320, DIG. 9, DIG. 10, DIG. 14, DIG. 17; 292/75, 144, 252

[56] References Cited

U.S. PATENT DOCUMENTS 3,771,823 11/1973 Schnarr ..... 292/270
3,964,125 6/1976 Tansley ..... 292/252
4,121,319 10/1978 Welch ..... 16/66
4,376,323 3/1983 Tillmann ..... 16/51
4,506,407 3/1985 Downey ..... 16/48.5

FOREIGN PATENT DOCUMENTS 713241 7/1965 Canada .
2320721 11/1973 Fed. Rep. of Germany .
2523154 12/1976 Fed. Rep. of Germany .
2541790 3/1977 Fed. Rep. of Germany .
2348185 8/1979 Fed. Rep. of Germany .

*Primary Examiner*—Donald R. Schran
*Assistant Examiner*—James L. Wolfe

[57] ABSTRACT

A door holding device for door closers is described in which a door is held only at a predetermined angle of opening and in which the selected holding position can remain unchanged over a long period of time but can nevertheless be released by electrical means. For this purpose the switching of the door is effected, starting from a known mechanical door holding device which can be switched in and switched out, via a control unit which is biased into a door holding position by the hydraulic pressure which is in any event present in the closer and which can be released again via a magnetic valve.

10 Claims, 5 Drawing Figures

HOLDING DEVICE FOR DOOR CLOSERS

BACKGROUND OF THE INVENTION

The invention relates to a holding device for door closers comprising a support member, which is axially displaceably guided in a reception chamber of the housing of the door closer, which is actuated in dependence on the movement of the closer shaft and which is formed, at least in part, as a hollow cylinder; an abutment member which is arranged in the reception chamber coaxial to the support member, with an oblique surface of a cone facing the abutment member and with the cone being biased towards the abutment member by a spring braced against the support member; and at least one locking element located between the cone and the abutment member, with the locking element being capable of being changed over between a release position in which it is located in the hollow cylindrical section of the support member and a blocking position in which it is disposed between an oblique end face of the support member, the cone and the abutment member.

A holding device of this kind is known from DE-PS 31 51 498. This known holding device is a purely mechanical device by means of which a door can be held at a specific angle of opening and in which no controlled release of the holding function is provided. If, in this known arrangement, the door is to be released then excess pressure must be exerted on the door, i.e. a force must be exerted on the door in the closing direction which is larger than the retaining force acting in the holding position, so that the holding arrangement is released and the door is returned to the closed position by the door closer.

A hydraulic holding device for door closers is known from DE-OS 25 23 154 in which the holding of the doors takes place at any desired angle or opening by preventing, of means of a valve, in particular an electromagnetically controlled valve, the flow of a hydraulic medium out of a pressure chamber which increases in size during the opening movement and decreases in size during the closing movement. A disadvantage of these known solutions is firstly that the doors can remain open that any desired angle, for example between 80° and 180°, although in practice the door should always be opened as far as possible and should remain held there. A typical example of this is a wall which extends at right angles to the door wherein, in the normal case, the opened doors should always contact this wall and should also remain there. Furthermore, it is a substantial disadvantage of the known hydraulic holding devices that creeping of the door in the direction of closing takes place, even with the smallest hydraulic leaks, which can mean that the door stands away from the wall only a few hours after it has been moved into the opened position, and no longer adopts the desired fully opened position.

The principle object underlying the present invention is to provide a holding device for door closers which makes it possible to hold the door open, in particular only at a predetermined angle of opening, and to maintain the selected opened position without change over periods of time which can be as long as desired, and which is electrically controllable in order to release the holding device. Furthermore, the constructional volume of this holding device should be kept as small as possible and the current consumption of the closer should be kept as low as possible.

SUMMARY OF THE INVENTION

This object is satisfied, starting from a holding device of the initially named kind, in that the support member is formed as a working piston which is acted on by the hydraulic pressure in the closer and moves in the reception chamber which acts as a damping chamber; in that the abutment member consists of a hollow cylinder in which a magnetic unit with a control unit is axially displaceably arranged and biased towards the working piston end of the hollow cylinder is closed by a wall; in that a control pin for axially displacing the cone by means of the control unit is guided through this wall; and in that the magnetic unit with the control unit is displaceable by the working pressure against the force of the bias spring and, under the control of the magnetic unit, can be held in and released from the resulting end position in which it is spaced from the control pin.

The control unit preferably consists of a control sleeve which can be blocked relative to the hollow cylinder forming the abutment member by means of at least one radially displaceable holding pin which cooperates with a deployment bolt, with the deployment bolt being capable of being fixed in the position corresponding to the blocking position of the holding pins by means of the magnetic unit.

Characteristic for the solution of the invention is the fact that a control head which acts as a piston can be clamped by means of a hydraulic pressure which is any event present in the closer and can be controllably released again via an integrated magnetic valve. Undesired creep effects due to leakages can be completely avoided by the use of mechanical locking systems.

This invention will not be described in the following in more detail with reference to embodiments and to the drawings, in which are shown:

FIG. 1 a schematic illustration of a section of the damping chamber of a door closer with the holding device being inoperative, FIG. 2 an illustration corresponding to FIG. 1 but with the holding device in the operative position, FIG. 3 a schematic illustration of a variant of the holding device of the invention in conjunction with a floor mounted door closer, FIG. 4 a possible arrangement of the holding device of FIG. 3 in a floor mounted door closer, and FIG. 5 a schematic cross-sectional representation of one half of a particularly preferred embodiment of the invention with the holding device in the operative position.

DETAILED DESCRIPTION OF PREFERRED EMBODIMENTS

Figure 1:
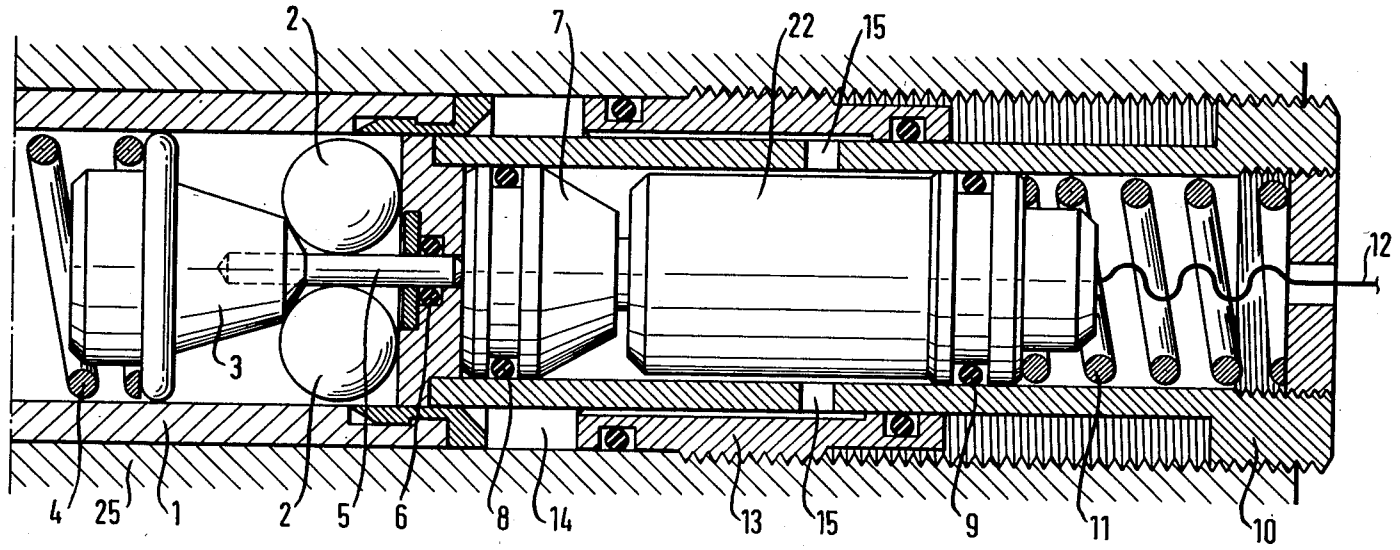

As seen in FIG. 1 a working piston 1 is arranged in the damping chamber 14 of a door closer. The working piston 1 is of tubular shape at least in the region on its free end ad illustrated and moves to the right in dependence on the movement of a closure shaft (not shown in FIG. 1, but similar in operation to closure axle 30) in FIG. 3. on closing of the associated door, thus forcing the oil present in the damping chamber out of the damping chamber via valves which are not illustrated. The oil filled intermediate spaces between the individual parts also belong to the damping chamber and it should also be pointed out that the full cross-sectional area of the piston 1 is effective to displace the oil.

In the inside of the working piston 1 which is displacable in the housing 25 there is located a cone 3 which is biased by means of a compression spring 4 in the direction towards the free end of the working piston 1. This cone cooperates with locking members 2 in the form of balls which are moved radially outwardly by the cone as a result of the action of the compression spring 4, provided the balls 2 are located outside of the working piston and not, as shown in the operating state of FIG. 1, prevented from moving radially outwardly by the working piston 1.

An abutment member 10 is fixedly mounted in the housing 25 and extends coaxial to the working piston 1. The abutment member 10 has the shape of a hollow cylinder and an outer diameter which makes entry into the tubular part of the working piston 1 possible. The working piston end of the abutment member 10 is closed by a wall and a control pin 5 which is connected with the cone 3 is guided through the wall and is sealed by an O ring 6.

The outwardly disposed end of the abutment member 10 which has a larger diameter is screwed into the housing 25 and can be left or fixed in various axial positions whereby different hold-open angles can be preselected. A support and sealing part 13 is located between the abutment member and the wall of the housing at a position corresponding to approximately half of the length of the abutment member. The support and sealing part 13 is likewise connected by screw threads to the wall of the housing and is sealed via O rings on one side with respect to the housing wall and on the other side with respect to the abutment member 10.

A magnetic unit 22 which is connected with a control head 7 and is biased in the direction towards the working piston 1 by a compression spring 11 is located in the cylindrical hollow chamber of the abutment member 10. The bias force of the spring 11 is made larger than the bias force of the spring 4 associated with the cone 3.

The feed lines 12 for the magnetic unit 22 are led out of the abutment member 10 via a suitable bore.

The control head 7 is sealed relative to the inner wall of the tubular abutment member 10 via an O ring 8 and a further O ring 9 is provided in the region of the magnetic unit 22 remote from the control head 7. Bores 15 which lead to the pressure chamber 14 are provided in the tubular wall of the abutment member 10 in the region between the two seals 8, 9.

In FIG. 1 the mechanical holding device is illustrated in the inoperative state which can be seen from the fact that the magnetic unit 22 with the control head 7 has moved fully to the left and has displaced the cone 3 against the force of the spring 4 via the control pin 5. Accordingly the cone 3 cannot exert any spreading function with regard to the balls 2 which again has the consequence that the balls cannot be moved in the radial direction, even during a door opening process in which the working piston 1 is moved to the left in the drawing, and thus that no holding of the door results.

In this operating state, which is predetermined solely by the mechanical circumstances, i.e. by the ratio of the forces of the springs 4, 11, the magnetic unit 22 is in the non-excited state, i.e. no current flows.

Figure 2:
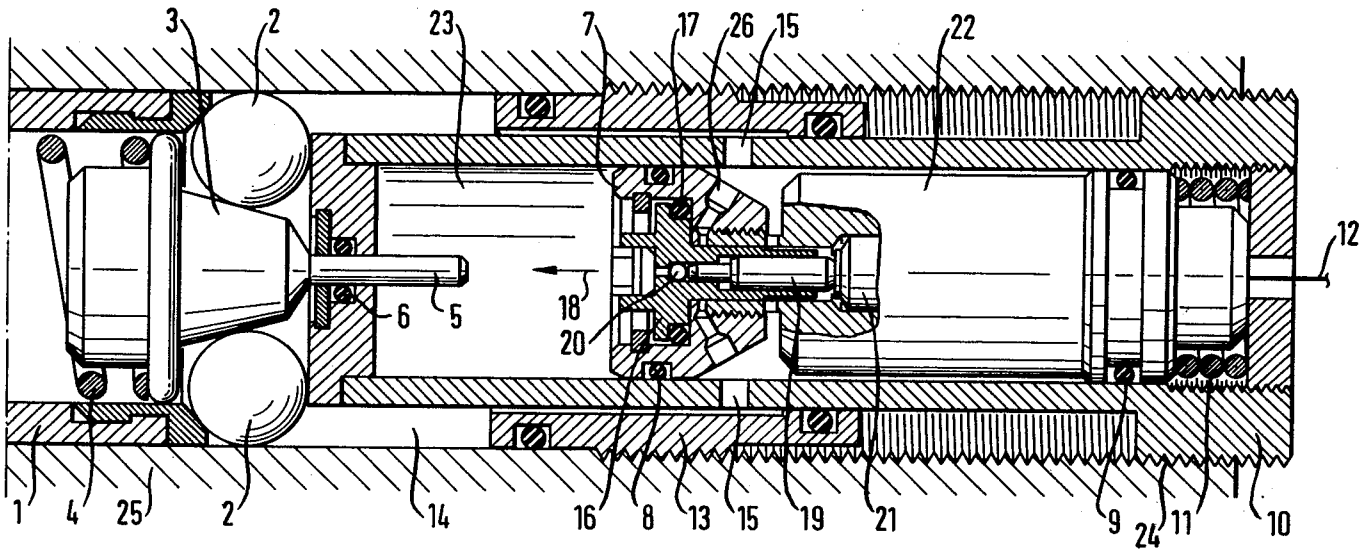

FIG. 2 shows the decribed arrangement in the operative door holding state.

In this state the balls 2 are located, after radial spreading has occurred, between an oblique end face of the working piston 1, the cone 3 and the abutment member 10 with the selected oblique surfaces ensuring on the one hand that the working piston does not move out of the holding position, i.e. cannot move to the right in the drawing and, on the other hand, that it is possible to move the door out of this held position if excessive force is applied. If, namely, a sufficiently high force is applied by hand to the held door in the closing direction then the balls 2 will be pushed radially inwardly as a result of the action of the inclined surfaces at the end face of the working piston 1, with the cone 3 simultaneously moving out of the way and the working piston 1 can now move in the closing direction.

The magnetic unit 22 with the control head 7 is located in FIG. 2 in its right hand end position, i.e. the control head 7 is spaced from the control pin 5 which is a prerequisite for the cone 3 being able to satisfy its spreading function with regard to the balls 2.

The magnetic unit 22 and the control head 7 have reached the position shown in FIG. 2 because the associated door has been opened starting from the position of FIG. 1 and the working piston or damping piston 1 has thereby moved to the left. The magnetic unit 22 and the control head 7 remain during this process in the position of FIG. 1, i.e. holding of the door is not possible.

During the subsequent closing of the door an oil pressure is created in the damping chamber 14 which brakes the door movement. This pressure also acts via the bores 15 on the cross-section of the magnetic unit 22 which is sealed against the outside via the O ring 9. As the internal pressure which is created in this way is higher than the external pressure and the force of the spring 11 the magnetic unit 22 with the control head 7 is moved to the right. However, this case still does not lead to holding of the door because the piston is already moving in the damping chamber in the closing direction and the balls 2 are again in contact with the inner wall of the piston 1.

If the magnetic unit 22 is energized with current and the magnet is excited then the magnetic unit remains with the control head in the position shown in FIG. 2 because the ball valve 20 is closed via the actuating pin 19, which is acted on by the armature 21, and the oil cannot run out of the pressure chamber 23. Even when the ball valve 20 is closed oil can flow into this pressure chamber 23 during the increase in volume of this pressure chamber 23, i.e. when the magnetic unit 22 moves contrary to the direction of the arrow 18, because the suction valve 16 which seals with an O ring 17 is formed in the control head 7. The connection to the pressure chamber 14 is provided in this arrangement via the bores 15 and 26.

So long as the magnetic unit 22 is energized and the valve 20 is closed in the operating phase shown in FIG. 2 the magnetic unit 22 and the control head 7 remain in the illustrated positions, i.e. the control pin 5 is not actuated and the door holding function remains in operation.

Even if minor leaks should occur, for example via the valve 20, which would lead to a very slow creeping of the magnetic unit 22 then no change of the hold open angle of the door would result. Only when the magnetic unit and thus the control head 7 have moved sufficiently far that actuation of the control pin 5 would arise would the door holding function be terminated. In this case the door must again be brought into the held position the next time it is opened.

It is evident that the energizing of the magnetic unit 22 with the associated control head 7 is brought about by the pressure generated during closing of the door closer. The consequence of this is that holding of the door is only possible on opening it for a second time because only then is the door holding function effectively brought into operation, and accordingly the cone 3 moved into the position shown in FIG. 2.

Release of the holding position takes place whenever the current which energizes the magnetic unit 22 is interrupted so that the valve 20 opens and as a consequence the magnetic unit 22 with the control head 7 moves to the left and actuates the control pin 5. Release of the door from the held position by hand is however possible at any time and indeed irrespective of the position of the magnetic unit 20 because it is only necessary to simple press the balls 2 out of their locking position.

Figure 3:
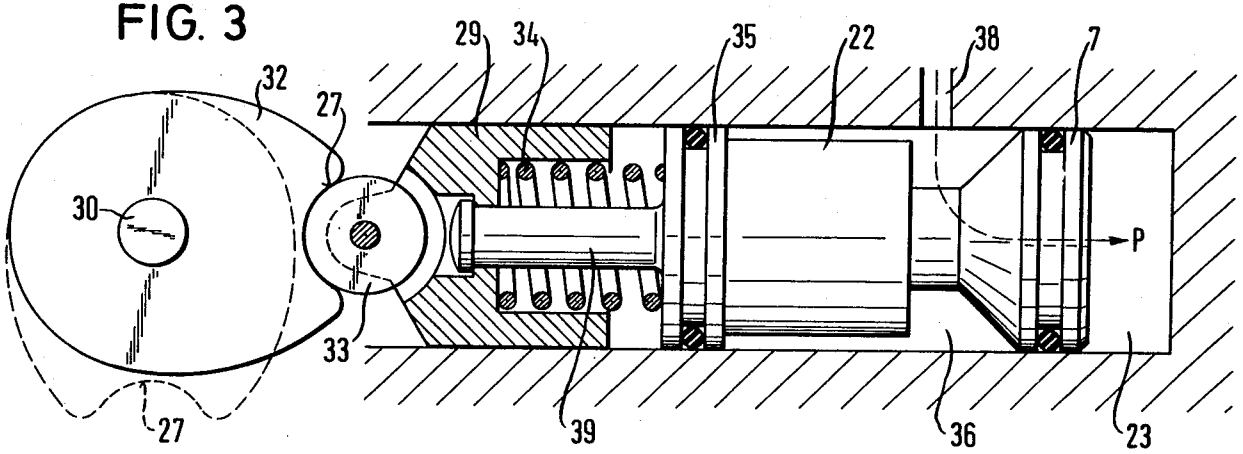

The embodiment of the invention shown in FIG. 3 is particularly suited for floor mounted door closers in which, when compared with the variant of FIGS. 1 and 2, a different latch mechanism is used. The principle of a switching in and switching out of the door holding function corresponds however to the principle discussed with reference to FIGS. 1 and 2.

As seen in FIG. 3 a cam disc 32 with a locking recess 27 is rotationally fixedly connected with the closer axle 30. A locking piston 29 which carries a roller 33 at its free end cooperates with this cam disc and is biased against the cam disc 32 by spring 34. If the roller 33 engages in the cam recess 27 then the closer axle 30 will be fixed in the predetermined position. The bias spring 34 is supported on abutment 35 which also carries a guide spigot 39 for the locking piston 29. This guide spigot 39 simultaneously restricts the axial movement of the locking piston 29.

The abutment 35 is constructed as a piston and sealed against the bore which guides this piston via an O ring. The magnetic unit 22 with the control head 7 is provided on the side of the abutment 35 opposite to the locking unit.

The control head 7 bounds a pressure chamber 23 and a connection chamber 36 is formed between the O ring seals of the control head 7 and of the abutment 35. A connection bore 38 opens into the connection chamber 36.

The construction of the magnetic unit 22 and the control head 7 corresponds to that of the embodiment explained with reference to FIGS. 1 and 2.

Figure 4:
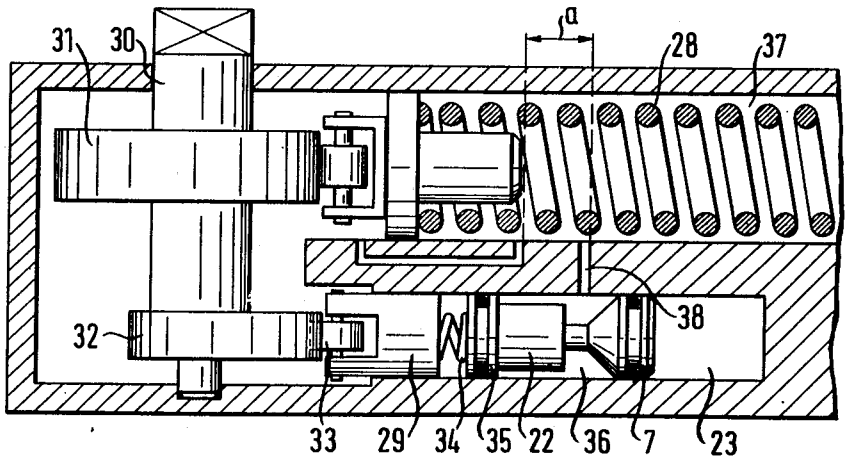

FIG. 4 shows the housing of the arrangement of FIG. 3 in a floor mounted door closer. The blind bore for accommodating the holding device runs in this arrangement parallel to the spring chamber 37 of the door closer which is filled with hydraulic fluid. In known manner a cam disc 31 connected to the axle 30 of the door closer cooperates with the closing spring 28. The connection bore 38 extends between the spring chamber 37 and the connection chamber 36.

The closer axle 30 is urged in the closing direction by the cam disc 31 and the associated spring 28. By reason of the simplified illustration the damping which is provided is not shown in the door closer of FIG. 4, however for this purpose a further cylinder could for example be provided.

The fixing is brought about by the locking cam disc 32 in which the roller 33 holds the closer and thus the door via the pressure spring 34.

The abutment 35 which acts as a piston can be switched over via the magnetic unit 22 and the control head 7. The energizing of the abutment, i.e. the pressure build up in the pressure chamber 23 is not brought about in the embodiment of FIG. 4 by the damping of the closing movement. Instead the pressure build up in the chamber 23 takes place during an opening process because a pressure increase occurs in the spring chamber 37 during door opening and corresponds, in accordance with the path "a" with a damping of the opening movement which can also be termed "throw open damping".

If, starting from the latched position shown in FIGS. 3 and 4, the magnetic unit 22 is de-energized then the valve in the control head 7 opens, the pressure in the pressure chamber 23 is dissipated and the abutment 35 moves in the direction of the end of the blind bore whereby the spring 34 relaxes and the door holding action is terminated. The door can now move to the closed position.

Figure 5:
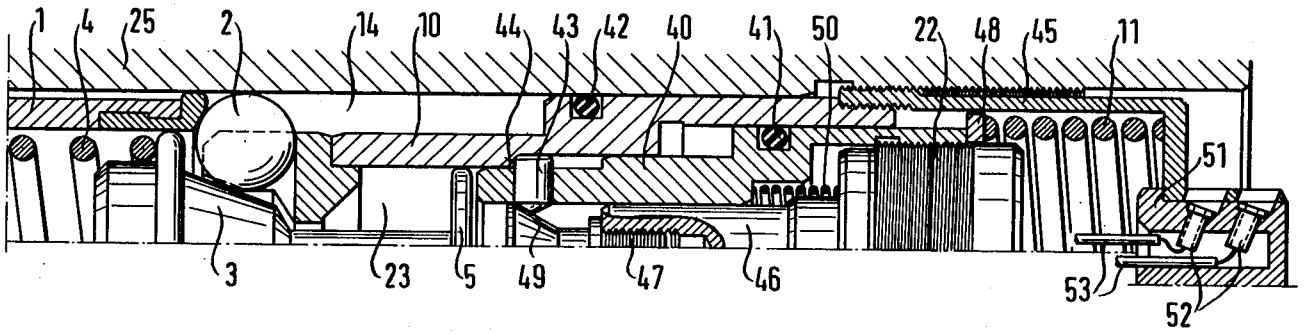

The embodiment shown in FIG. 5 is preferably intended for floor mounted door closers and operates with a mechanical locking system which prevents any form of creeping effect of the door closer.

Parts shown in the representation of FIG. 5 which correspond to parts of the previously described embodiments are characterized in FIG. 5 with the same reference numerals.

As in the previously described arrangements a unit which switches the ball locking of the mechanical holding arrangement in and out is screwed into the end of the damping chamber of the door closer and indeed via adjustment sleeve 45 which is screwed to the abutment member 10. All the movable parts are contained in the interior of the adjustment sleeve 45 and of the abutment member 10. The adjustment of the sleeve 45 in the axial direction makes it possible to select the particular angle at which the door is to be held open.

A control sleeve 40 is axially displaceably guided in the abutment member 10 and is biased by the compression spring 11 which is braced against a rear wall of the adjustment sleeve 45. An O ring 41 is provided for sealing purposes between the control sleeve 40 and the abutment member 10. The control sleeve 40 is mechanically lockable relative to the abutment member 10 and indeed via retaining pins 43 which are distributed around the periphery in the region of the free end of the control sleeve 14 and are guided for radial displacement in corresponding bores of the control sleeve 40. These retaining pins 43 can cooperate with an internal inclined surface 44 on the abutment member 10 and they block an axial movement of the control sleeve 40 when they contact this abutment surface 44.

The magnetic unit 22 is screwed tightly into the control sleeve 40. The electrical lines are formed by the cables 53 which are connected with the sockets 52 into which an electrical feed cable can be plugged.

A holding bolt 46 which is displaceable in the control sleeve 40 is associated with the magnetic unit 22. The holding bolt 46 is screwed onto a deployment bolt 47 which has a conically widened part at its free end with a positioning surface 49 which cooperates with the retaining pins 43. In the illustrated position the magnetic unit 22 holds the holding bolt 46 fixed, i.e. current flows through the magnet in the illustrated position. A comparatively weak deployment spring 50 is arranged between the holding bolt 46 and an internal ring seat of the control sleeve 40.

The described arrangement operates as follows.

In the illustrated position the closer is in the operative door holding state because the balls 2 are pushed radially outwardly via the cone 3 and the control pin 5 is not actuated by the control sleeve 40, i.e. is not displaced to the left. Current flows through the magnetic unit 22.

If the current is now switched off the compression spring 11 which acts against the support ring 48 of the control sleeve 40 presses the holding pins 43 radially inwardly via the inclined surface 44 so that the mechanical blocking of the control sleeve 40 is released. This radial displacement of the holding pins 43 is possible because the holding bolt 46 together with the deployment bolt 47 is released by the magnet and thus the holding pins 43 can no longer be held in their radially outer position via the positioning surface 49.

As soon as the retaining force on the retaining pins 43 is removed the control sleeve 40 together with the parts contained therein moved to the left as a result of the force of the spring 11. As a consequence the control pin 5 is also moved with the control sleeve which removes the retaining force on the locking balls 2. The force of the spring 11 is always greater than the force of the compression spring 4.

If the door closer is now to be returned into the door holding state then the magnetic unit 22 must be energized with current. As however one is only concerned with a holding magnet the latter is not able to draw the holding bolt 46 into position. This would also not be possible because in the switched off position the holding pins 43 are still located in the narrower diameter portion of the abutment member 10.

On actuating the door closer once a pressure however arises in the piston chamber which acts on the control sleeve 40, over the cross-sectional area of the cross-section sealed by the O ring 41, and moves the control sleeve to the right against the force of the spring 11. The control sleeve 40 is pressed rearwardly as a result of this pressure until the compression spring 11 has blocked. The retaining pins 43 then come into the larger diameter region of the abutment member 10 and are spread by the movement of the holding bolt 46 to the right, and indeed as a result of the auxiliary force of the very weak deployment spring 50. This deployment spring 50 brings the holding bolt 46 up to the holding magnet and the holding magnet now holds the holding bolt by its magnetic force. The holding pins 43 now again block the control sleeve 40 against movement to the left, i.e. the door is again held in a fixed position.

This mechanical locking of the release unit makes the function of the described device completely independent of any leakages so that creeping problems are reliably precluded.

We claim:

1. A holding device for door closers comprising a housing for the door closer; a chamber in said housing defining a damping chamber of said door closer; a working piston formed, at least in part, as a hollow cylinder and having an oblique end face, said working piston being axially displaceably guided in said damping chamber; a closer shaft movably supported in said housing and coupled to said working piston, whereby said working piston is actuated in dependence on the movement of said closer shaft and is axially displaced within said damping chamber to displace hydraulic fluid contained therein to produce damping of the door closing movement of said door closer; an abutment member arranged in said damping chamber coaxial to said working piston, said abutment member consisting of a hollow cylinder having an end adjacent said working piston; a cone having an oblique surface, said cone being disposed in said damping chamber, with said oblique surface facing said abutment member; a first spring disposed in said damping chamber, said spring being braced against said working piston and said cone to bias said cone towards said abutment member; at least one locking element located between said cone and said abutment member; said locking element being capable of being changed over between a release position in which said locking element is located in said hollow cylinder of said working piston and a blocking position in which said locking element is disposed between said oblique end face of said working piston, said oblique surface of said cone and said abutment member; a magnetically actuatable control unit axially displaceably arranged within said abutment member; a second spring disposed within said abutment member for biasing said control unit towards said working piston; and a control pin between said cone and said control unit whereby said cone can be axially displaced by axial movement of said control pin to permit entry of said locking member into said release position; wherein said control unit is displaceable in response to displacement of hydraulic fluid against the force of said second spring to an end position within said abutment member in which said control unit is spaced from said control pin, wherein said control unit can be held in and released from said end position depending on whether said control unit is in a magnetically actuated state or in a non-actuated state, and wherein on release of said control unit from said end position said control unit moves towards said control pin under the force of said second spring, to produce said axial movement thereof.

2. A holding device in accordance with claim 1, wherein the force of said second spring is larger than the force of said first spring.

3. A holding device in accordance with claim 1, wherein said control pin is connected with said cone and extends into a pressure chamber provided in said abutment member, said pressure chamber being bounded at one end by a wall at the working piston side and at the other end by an axially displaceable control head of said control unit which sealingly contacts an inner wall of said abutment member, and wherein said control unit comprises a suction valve provided within said control head for connecting said pressure chamber with said damping chamber when the volume of said pressure chamber increases, and a magnetically controlled ball valve which lies between said pressure chamber and said damping chamber.

4. A holding device in accordance with claim 1, wherein said abutment member is screwed into said housing at a screwed connection and can be fixed in different axial positions; and wherein a seal is provided between said abutment member and a wall of said housing in the region of said screwed connection.

5. A holding device in accordance with claim 1, wherein said control unit consists of a control sleeve which can be blocked relative to said hollow cylinder of said abutment member by means of at least one holding member which is moveable from a radially inner position to a radially outer position, said holding member cooperating with a deployment bolt; and wherein said deployment bolt can be fixed into a position corresponding to a blocking position of said at least one holding member by means of an electromagnet.

6. A holding device in accordance with claim 5, wherein said holding member is a radially displaceable holding pin.

7. A holding device in accordance with claim 6, wherein said at least one holding pin can be moved via an inclined surface provided on said deployment bolt between a released position in which a radially outer end of said at least one holding pin is disposed within the peripheral contour of said control sleeve and a blocking position in which said radially outer end contacts an inclined surface on an inner wall of said abutment member.

8. A holding device in accordance with claim 7, wherein said electromagnet is constructed as a holding magnet and wherein a weakly dimensioned spring which urges said deployment bolt in an axial direction producing movement of said at least one holding pin into said blocking position is arranged between said control sleeve and said deployment bolt which acts as a holding bolt.

9. A holding device for door closers with a latching device and comprising a housing; a closer axle mounted in said housing; a first chamber in said housing defining a hydraulic chamber; a working piston disposed within said first chamber; means coupling said working piston to said closer axle whereby said piston is actuated to execute axial damping movement in said first chamber while displacing hydraulic fluid present in said first chamber; and a first bias spring acting on said closer axle via said working piston; said latching device comprising a cam disc mounted on said closer axle, said cam disc having at least one latch recess; and a latching unit axially movably disposed in a second chamber in said housing; said latching unit including a latch member engageable in said latch recess; a support abutment disposed behind said latch member in said second chamber and axially movable therein; a control head connected to said support abutment; a compression spring disposed within said second chamber and bearing on said latch member and on said support abutment; said support abutment being axially movable within said second chamber and being hydraulically supportable in a latching position by said control head; a communicating bore extending from said first chamber into said second chamber at a position between said support abutment and said control head; a pressure chamber defined in said second chamber on a side of said control head remote from said support abutment; and a magnetically controllable valve disposed in said control head, whereby displacement of said working piston in said first chamber displaces hydraulic fluid into said pressure chamber and urges said control head, said support abutment and said latch member into said latching position, and whereby closure of said magnetically controllable valve traps hydraulic fluid in said pressure chamber thus hydraulically supporting said support abutment in said latching position, said latching device being releasable by opening said magnetically controllable valve.

10. A holding device in accordance with claim 9, wherein a connection chamber having first and second ends and sealed at said ends by O rings is formed between said support abutment and said control head and is connected with said pressure chamber via a one-way valve in said control head.

* * * * *